US007624933B2

(12) United States Patent
Boekelman

(10) Patent No.: US 7,624,933 B2
(45) Date of Patent: Dec. 1, 2009

(54) VARIABLE REACTIVE FORCE ARRANGEMENT FOR POLE MOUNTED, PRESSURE WASHING LANCES

(76) Inventor: Tracy Boekelman, P.O. Box 521, Kirkland, WA (US) 98083

( * ) Notice: Subject to any disclaimer, the term of this patent is extended or adjusted under 35 U.S.C. 154(b) by 43 days.

(21) Appl. No.: 11/998,590

(22) Filed: Nov. 29, 2007

(65) Prior Publication Data

US 2008/0210775 A1 Sep. 4, 2008

Related U.S. Application Data

(63) Continuation of application No. PCT/US2007/010504, filed on Apr. 30, 2007.

(60) Provisional application No. 60/796,788, filed on May 1, 2006.

(51) Int. Cl.
*B05B 9/00* (2006.01)

(52) U.S. Cl. ..... 239/124; 239/126; 239/444; 239/532; 239/569

(58) Field of Classification Search ..... 239/124, 239/525, 531, 532, 280, 280.5, 281, 444, 239/445, 569; 134/198, 184; 169/24, 51, 169/52; 137/625.47, 625.48; 4/601; 401/136
See application file for complete search history.

(56) References Cited

U.S. PATENT DOCUMENTS 1,745,972 A * 2/1930 Beck ..... 239/532
2,122,559 A * 7/1938 Dapero et al. ..... 239/273
3,023,971 A * 3/1962 Milhous ..... 401/137
3,672,575 A * 6/1972 Hinrichs ..... 239/445
3,765,607 A * 10/1973 Pacht ..... 239/124
3,870,045 A * 3/1975 Vaughan ..... 604/84
3,915,382 A * 10/1975 Davis ..... 239/195

(Continued)

FOREIGN PATENT DOCUMENTS

JP 01-254283 A 10/1989

(Continued)

OTHER PUBLICATIONS

International Search Report, from International Application No. PCT/US2007/010504 dated Oct. 29, 2007.

*Primary Examiner*—Dinh Q Nguyen
(74) *Attorney, Agent, or Firm*—Graybeal Jackson LLP

(57) ABSTRACT

Apparatus and methods for establishing a controllable reactive thrust in a pressure washing lance (40) linked to an extension member (20) through use of a variable bypass valve (52) and dump tube (66) combination. The bypass valve (52) is coupled to a source of high pressure fluid by a system high pressure or primary circuit (26,38). The bypass valve (52) preferably has at least one bypass input (56), which is intended to be fluidly coupled with the high pressure or primary circuit (38), and at least one each of a bypass primary output (58) and a bypass secondary output (60). Operation of the bypass valve (52) selectively couples the bypass input (56) with the bypass primary output (58) and/or the bypass secondary output (60). Fluid from the bypass primary output (58) is directed to the lance ejection nozzle (44) while fluid from the bypass secondary output (60) (secondary fluid) is directed to the dump tube (66). Dump tube output can also be modified to provide a reactive thrust and vectored by adjustment of the tube bend (67*b*) and a nozzle (68) thereon.

19 Claims, 4 Drawing Sheets

U.S. PATENT DOCUMENTS 3,986,523 A * 10/1976 Pacht ..... 137/882
4,752,975 A * 6/1988 Yates ..... 4/601
4,901,927 A * 2/1990 Valdivia ..... 239/446
4,930,664 A * 6/1990 Ellison ..... 222/1
5,199,642 A * 4/1993 Rankin ..... 239/124
5,655,563 A * 8/1997 Johnson ..... 137/115.15
5,788,160 A * 8/1998 Woog ..... 239/282
5,816,275 A * 10/1998 Mullen ..... 134/141
5,887,801 A * 3/1999 Stevens ..... 239/590
5,944,055 A * 8/1999 Dicky ..... 137/625.47
6,032,877 A * 3/2000 Kagan ..... 239/446
6,079,639 A * 6/2000 Barbato ..... 239/525
6,233,757 B1 * 5/2001 Graham et al. ..... 4/601
6,322,006 B1 * 11/2001 Guo ..... 239/532
6,341,738 B1 * 1/2002 Coles ..... 239/526
6,345,397 B1 * 2/2002 Haubrich ..... 4/615
6,378,922 B1 * 4/2002 Troudt ..... 294/19.1
6,402,891 B1 * 6/2002 Asher et al. ..... 162/199
6,675,834 B1 * 1/2004 Lai ..... 137/625.47
6,705,539 B1 * 3/2004 Bien ..... 239/10
6,880,767 B2 * 4/2005 Herhold ..... 239/124
6,905,080 B2 * 6/2005 Pohorecki ..... 239/280
6,926,213 B2 * 8/2005 Coles ..... 239/526
7,007,390 B2 * 3/2006 Mislove ..... 30/41.5
7,028,925 B2 * 4/2006 Guest et al. ..... 239/526
7,083,124 B2 * 8/2006 Bednorz et al. ..... 239/526
7,255,131 B2 * 8/2007 Paper et al. ..... 137/625.47
2001/0042797 A1 * 11/2001 Shrigley ..... 239/548
2001/0052355 A1 * 12/2001 Hoenisch et al. ..... 134/123
2003/0071142 A1 * 4/2003 Pohorecki ..... 239/280
2003/0132316 A1 * 7/2003 Saunders et al. ..... 239/463
2004/0118940 A1 * 6/2004 Lavitt ..... 239/302
2004/0144855 A1 * 7/2004 Herhold ..... 239/124
2004/0217185 A1 * 11/2004 Bien ..... 239/10
2005/0029366 A1 * 2/2005 Troudt ..... 239/532
2005/0081899 A1 * 4/2005 Shannon ..... 134/172
2006/0260654 A1 * 11/2006 Denney ..... 134/34
2006/0272086 A1 * 12/2006 Mesa ..... 4/601
2007/0051834 A1 * 3/2007 Dexter et al. ..... 239/526
2007/0158460 A1 * 7/2007 Lev ..... 239/132.1
2007/0170288 A1 * 7/2007 Troudt et al. ..... 239/587.5

FOREIGN PATENT DOCUMENTS

JP 06-007757 A 1/1994
JP 2000-279908 A 10/2000

* cited by examiner

VARIABLE REACTIVE FORCE ARRANGEMENT FOR POLE MOUNTED, PRESSURE WASHING LANCES

This is a continuation application that claims benefit, under 35 USC §120, of co-pending International Application PCT/US 2007/010504, filed on 30 Apr. 2007, designating the United States, which claims priority to U.S. Provisional Application No. 60/796,788, filed on 01 May 2006, which applications are incorporated herein by reference.

BACKGROUND OF THE INVENTION

In the field of telescoping pressure washing poles, conventional arrangements comprise a telescoping pole having a lance with a nozzle at a distal end, a high pressure hose disposed within the body of the telescoping pole, an on-off trigger at a proximal end for user operation, and an open end at the proximal end of the pole so that excess fluid in the high pressure hose can be ejected when collapsing the pole or taken in when extending the pole. The free end of the high pressure hose is then attached, either directly or indirectly, to a source of high pressure fluid, commonly water or water mixed with a detergent or other cleansing agent.

While simple, telescoping pressure washing poles of the prior art perform their intended purpose, i.e., delivering high pressure fluid to a target surface that is physically removed from the operator. However, maneuvering of the telescoping pole when the target surface is relatively distant from the operator is less than easy. By only having a fixed pressure level and, therefore, a fixed volume of fluid exiting from the nozzle, significant bend in the pole can be created, whether desired or not. This is especially true when attempting to clean higher areas and/or trying to get the nozzle closer to the target surface. This makes the pole harder to handle and creates undesirable control force upon the operator. Also, if the nozzle becomes misaligned, the force of the pressure will work against the operator, and the operator may have to completely interrupt the high pressure water and realign the nozzle. In addition, telescoping poles are notoriously heavy and an operator must usually lift the pole into the desired cleaning position, then operate the on/off trigger to start the cleaning process. Often times, the operator will need an assistant to help in moving or controlling the movement of the pole. Moreover, manually holding the on/off trigger in the on position can quickly tire the operator's hands, which also makes it more difficult to wrangle the pole to the desired positions.

SUMMARY OF THE INVENTION

The invention is directed to apparatus and methods for establishing a controllable reactive thrust in a pressure washing lance linked to an extension member, and for assisting an operator in maneuvering or positioning the lance during operation thereof. Reactive thrust is controlled in apparatus embodiments of the invention by a variable bypass valve and dump tube combination, which retains the standard functionality of a coupled pressure pump of a pressure washer. The bypass valve is preferably coupled to a source of high pressure fluid by a system high pressure or primary circuit, which comprises the structure defining a fluid path between the pressure pump (upstream) and the bypass valve. The bypass valve preferably has at least one bypass input, which is intended to be fluidly coupled with the high pressure or primary circuit, and at least one each of a bypass primary output and a bypass secondary output. Operation of the bypass valve selectively couples the bypass input with the bypass primary output and/or the bypass secondary output. Fluid emanating from the bypass primary output is ejected from the lance ejection nozzle while fluid emanating from the bypass secondary output (secondary fluid) is ejected from the dump tube.

Reactive thrust is controlled in certain method embodiments of the invention by selectively directing fluid from the pressure pump to the bypass primary output and/or the bypass secondary output wherein the secondary fluid is ejected from the dump tube so as not to create appreciable reactive thrust. Reactive thrust is controlled in other method embodiments of the invention by selectively directing fluid from the pressure pump to the bypass primary output and/or the bypass secondary output wherein the secondary fluid is ejected from the dump tube so as to create appreciable reactive thrust and wherein the ejection vector is not substantially coincident with the fluid emanating from the lance ejection nozzle.

In the first series of embodiments, the secondary fluid is intended to be benign. Therefore, preferred embodiments of the invention in this regard provide means for minimizing the kinetic energy of the secondary fluid when ejected from the dump tube. Moreover, preferred embodiments of the first series further direct the secondary fluid neither towards the target surface to be cleaned nor towards the bypass valve. In the second series of embodiments, the secondary fluid is intended to be exploited. Therefore, preferred embodiments of the invention in this regard provide means for maximizing the kinetic energy of the secondary fluid. Moreover, preferred embodiments of the second series further direct the secondary fluid neither towards the target surface to be cleaned nor towards the bypass valve, but in a direction intended to provide desired reactive thrust.

Kinetic energy ("KE") for a moving mass is determined according to the following equation: $KE=\frac{1}{2}m\cdot v^2$ where "m" is the mass and "v" is the velocity of the moving mass. Thus, increasing the velocity of a given mass or increasing the mass of an object moving at a constant velocity increases kinetic energy. Newton's Third Law of Motion requires that for every action there is an equal and opposite reaction, in a closed system and all other variables being held constant. In the field of the invention, this means that the higher the ejection speed of a defined volume of fluid from a pressure lance, the greater will be the reactive force generated thereby.

As noted in the "Background" section, the reactive forces generated at the lance ejection nozzle by a conventional pressure washer can materially affect the directional stability of the extension member, e.g., pole, used to support the lance. While it is possible to vary the volume (mass) of ejected fluid, a much more effective mode of modifying the reactive force is to modulate the velocity of ejected fluid; any difference is subject to a square function as opposed to linear function. A conventional mode for velocity modulation of a fluid stream is to vary the orifice size at an ejection nozzle—a small diameter orifice provides high pressure (but less volumetric flow for a given pump output) and therefore high velocities while a large diameter orifice provides low pressure (but great volumetric flow for a given pump output) and therefore low velocities. From a practical perspective, however, is it not convenient to change the size of an ejection orifice or inexpensive to provide a variable orifice arrangement capable of being remotely operated. By the same token, many pressure washing pumps are of a constant volume type; modification of the speed or output is not possible. A more practical mode of modulation is to vary the volume of fluid reaching the lance ejection nozzle.

In view of the foregoing and in selected embodiments of the invention, the bypass valve modulates the volume of fluid emanating from the pressure pump to the bypass primary output and/or the bypass secondary output. If fluid is directed to the bypass secondary output, this secondary fluid is ejected through a dump nozzle fitted to a dump tube. The dump nozzle, which may simply be a distal end of the dump tube (i.e., no separate fitting) preferably comprises an orifice that does not appreciably increase the fluid pressure upstream of the dump nozzle, that is the circuit back pressure. As a consequence, the waste fluid exit velocity is nominal, which therefore does not materially increase reactive forces to the lance or other structure to which the dump nozzle is linked. In many embodiments of the invention, the dump nozzle directs the secondary fluid away from both the washing target and the operator, such as generally towards the ground or area between the target and the operator.

In other selected embodiments, the secondary fluid directed to the secondary output circuit is ejected through an auxiliary nozzle of the dump tube, which is preferably directional. In these embodiments, output velocity is maximized in order to generate as much reactive force as possible for a defined mass of fluid. As opposed to minimizing the effects of the secondary fluid, embodiments of the invention according to this approach will use the reactive force potential of the secondary fluid to improve the balance and/or operational characteristics of an equipped lance. In particular, the reactive thrust can be directed through positioning at least one auxiliary nozzle fluidly coupled to the dump tube in a manner desired by a user, and preferably in a direction not coincident with the direction of the primary ejection nozzle.

As intimated above, there is at least one auxiliary nozzle, which may be fixed in direction or positionable, through which the secondary fluid in the dump tube may emanate. A plurality of auxiliary nozzles can also be used if multiple reactive thrust vectors are desired. Moreover, secondary fluid can be directed to a manifold or other fluid distribution device and further modulated to a plurality of auxiliary nozzles, thereby permitting the separate control of at least some of the plurality of auxiliary nozzles.

In the former embodiments, high pressure fluid entering the variable volume valve is directed to the bypass primary output and/or the bypass secondary output. Thus, if at least a portion of the high pressure fluid entering the bypass valve is presented to the bypass secondary output when, for example, the bypass valve is not in the full "open" position, fluid is redirected to the dump tube that extends, preferably, substantially parallel to the high pressure hose, and exits via a dump nozzle at a distal end thereof. The skilled practitioner will of course realize that the dump tube may be constructed from any suitable fluid carrying material, and need not be high pressure resistant. Depending upon the volumetric flow, orientation of the bypass secondary outlet, carrying capacity of the bypass tube and other factors that are known to those persons skilled in the art, a reactive force or thrust at the dump nozzle ejection point is created that affects the inertial state of the equipped telescoping pole.

By establishing suitable parameters for exploiting the reactive force or thrust created by the bypass secondary outlet in the second series of embodiments, an operator can use this force to assist him with positioning the telescoping pole. For example, if the bypass outlet is directed downward during washing operations, the reactive force will urge the extension member upward. By increasing the pressure or volumetric flow of the bypass circuit through operation of the bypass feature, which is preferably integrated into the variable volume valve, the extension member is urged upward, thereby eliminating the requirement for using assistance during such an operation. Further embodiments of the invention provide for multiple bypass secondary outlets where the operator may select between the multiple outlets, depending upon the direction of reactive thrust desired. Thus, if downward thrust is desired, for example, when the angle between the target surface and the operator's position relative to that surface is small, the operator may direct a portion of the high pressure fluid to such circuit, and thereby counteract the lance ejection nozzle reactive thrust, thereby lessening the effort the operator must expend in order to retain the nozzle in the correct geometry and distance relative to the surface.

In view of the unique combination of elements of the invention, use of embodiments of the invention will result in more efficient pressure washing activities. For example, in embodiments wherein the waste fluid is not used for reactive thrust purposes, an operator may start by having the lance and supporting structure completely laid out in the desired length needed to do the cleaning, with the fluid pump already delivering fluid to the binary valve and most of the fluid going through the bypass valve and secondary outlet when a trigger gun or other binary valve is opened. When cleaning operations are desired, the operator need only adjust the bypass valve to modulate the amount of fluid delivered to the lance ejection nozzle. In conjunction with an angled ejection path, the lance and supporting structure will develop a lifting bias, which will assist the operator in elevating and positioning the structure. As the geometry between the operator and the target changes, so do the angles that the lance and related structure make with the ground and the target. By modulating the bypass valve, the degree of reactive thrust generated by the lance ejection nozzle can be varied, thereby reducing the operator force necessary to maintain proper balance of the structure.

For embodiments wherein the secondary fluid is used for lift and/or position assistance, the operator need only adjust a dump tube nozzle as needed for the type of assistance desired, and can then modulate the bypass valve accordingly. In addition, embodiments of this type may also have a second bypass valve and secondary outlet that permits discharge of the fluid in a manner that generates no appreciable reactive thrust. Also, more than one positioning nozzle at the dump tube may be used. Based upon the foregoing, it will be realized that embodiments of the invention can employ multiple bypass circuits having uniquely oriented dump nozzles, where each circuit is selectable by the operator either in conjunction with or to the exclusion of the primary circuit.

DETAILED DESCRIPTION OF CERTAIN INVENTION EMBODIMENTS

Figure 1:
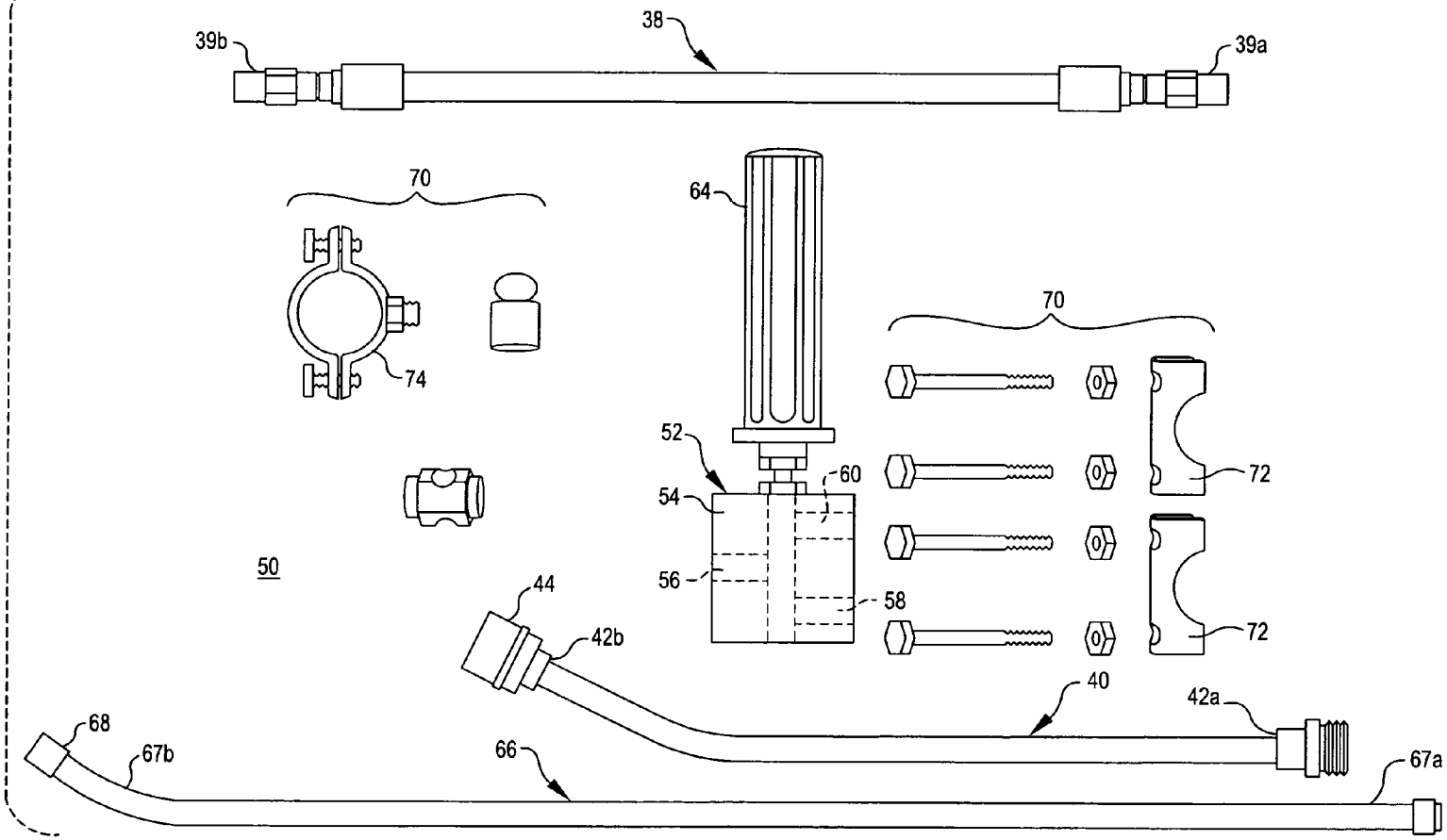
FIG. 1 is a detailed plan view of a kit embodiment of the invention, wherein the kit components can be used to retrofit an existing pressure washing system or incorporated into an original equipment system.
Figure 2:
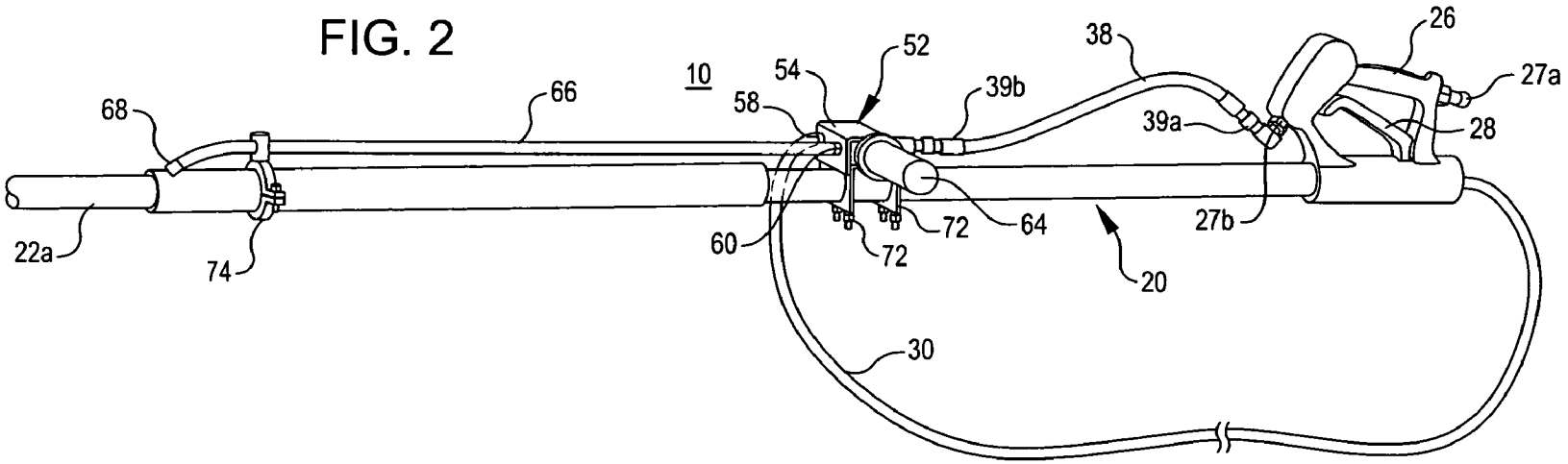
FIG. 2 is a detailed plan view of the kit of FIG. 1 shown as a retrofit of an existing pressure washing pole assembly.

Turning then to the several drawings, wherein like numerals indicate like parts, and more particularly to FIG. 1, aftermarket kit 50 according to the invention is shown. Kit 50, also referred to as variable reactive force arrangement 50, comprises bypass hose 38, lance 40, bypass valve 52, dump tube 66 and associated mounting hardware collectively referred to as hardware 70. Unless otherwise noted or contrary to industry standard, all metal parts are preferably constructed from brass or chrome plated brass, and all flexible parts are preferably constructed from rubber derivatives, and are capable of operating with working pressures up to 4,000 psi.

Bypass valve 52 comprises housing 54, which defines inlet 56, primary outlet 58 and secondary outlet 60. A diverter (not shown) in housing 54, variably exposes primary and/or secondary outlets 58 and 60, respectively, to inlet 56 when diverter handle 64 is operated. As will be described in more detail below, bypass valve 52 modulates the volume, and thus indirectly the pressure, of fluid directed to ejection nozzle 44.

Figure 3:
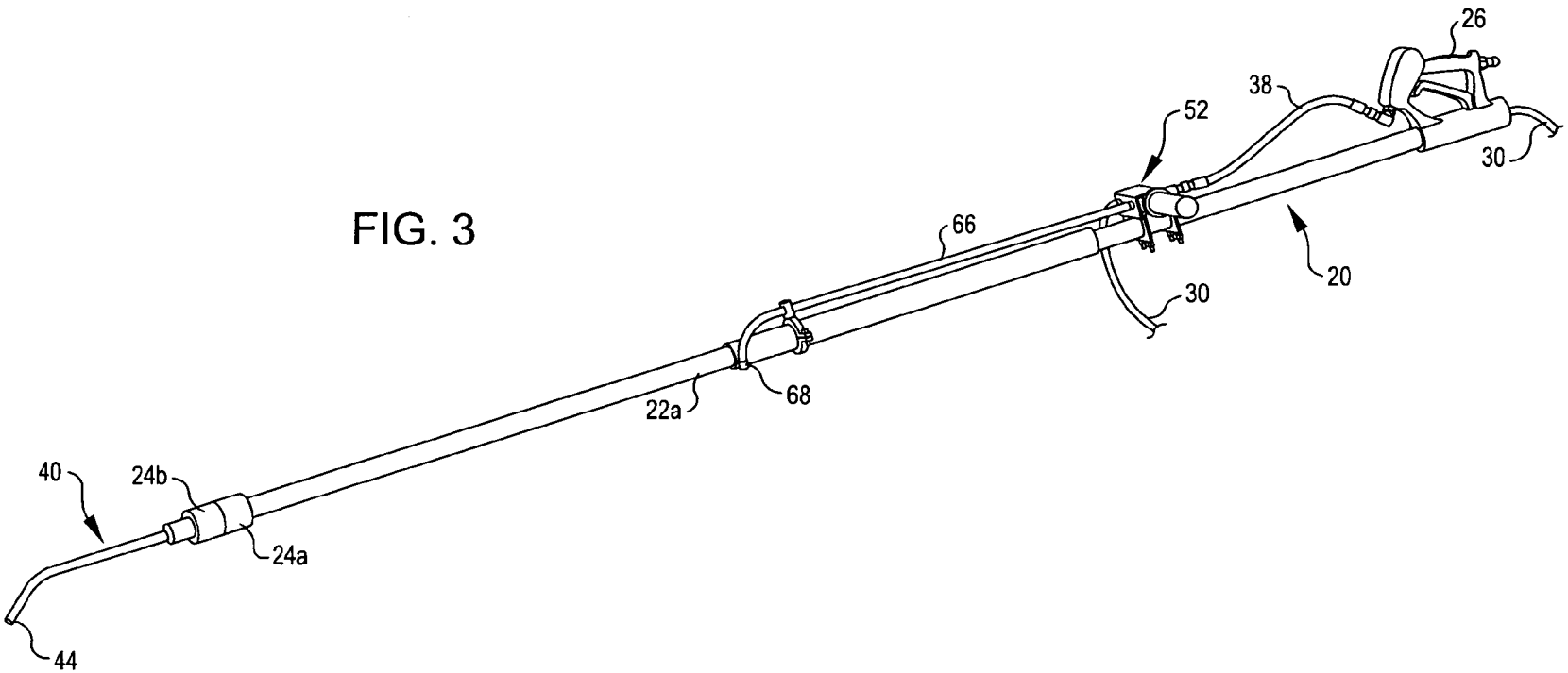
FIG. 3 is a general plan view of the embodiment shown in FIG. 2.
Figure 4:
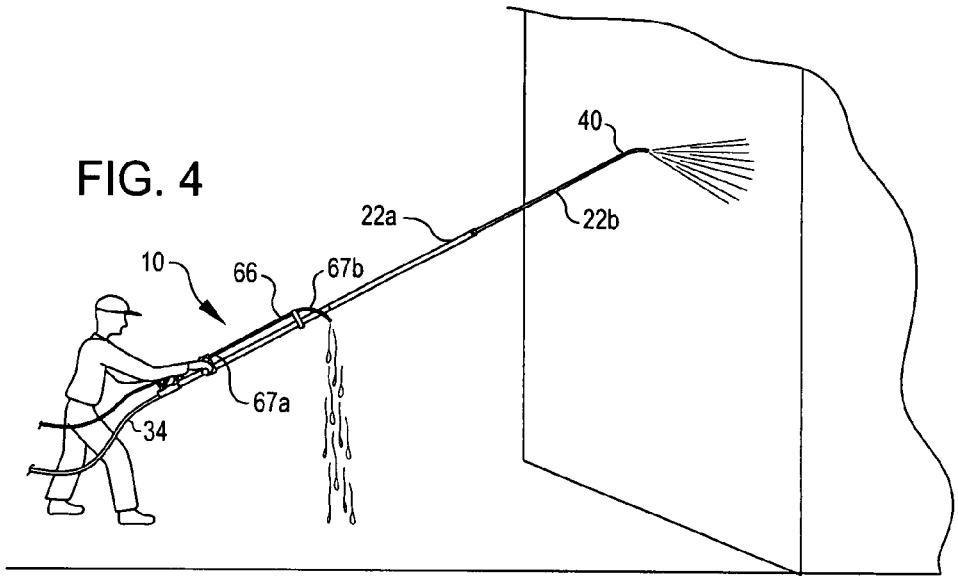
FIG. 4 is a schematic representation of a first embodiment of the invention during use.
Figure 5:
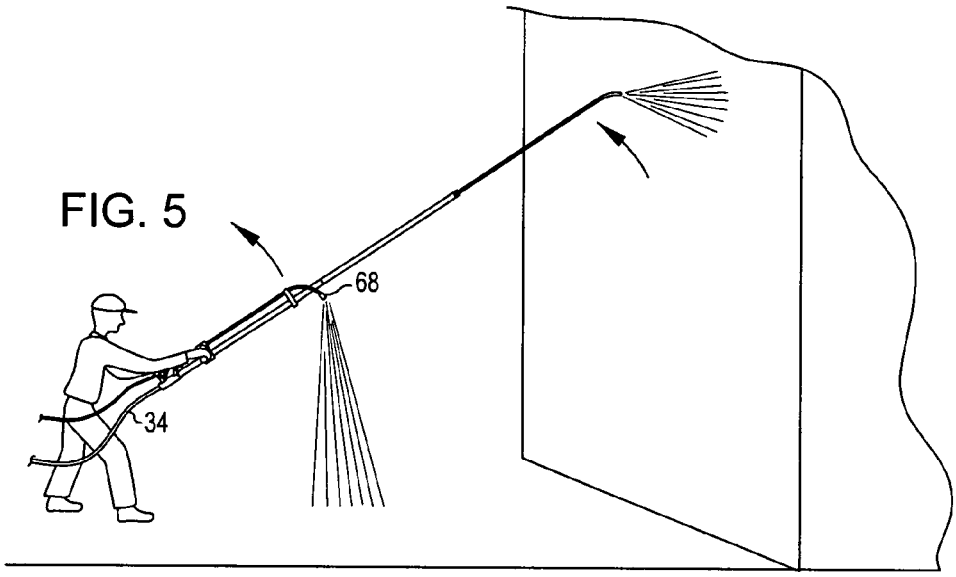
FIG. 5 is a schematic representation of a second embodiment of the invention during use.

Returning to FIG. 1, fluidly coupled to inlet 56 during operation of a system incorporating kit 50 is end 39*a* of flexible bypass hose 38, while primary outlet 58 is sized to fluidly couple with end 31*a* of primary hose 30. In addition, fluidly coupled to secondary outlet 60 is end 67*a* of dump tube 66. Because kit 50 is intended to integrate with an existing pressure washing system, the remaining disclosure will also reference FIG. 3, which illustrate kit 50 mounted to such a system, and hereinafter referred to as assembly 10. As shown therein, end 39*b* of flexible bypass hose 38 is coupled to outlet 27*b* of trigger housing 26. Coupled to inlet 27*a* of trigger housing 26 is hose 34. Finally, end 31*b* of primary hose 30 is coupled to end 42*a* of lance 40 after having been routed through sections 22*a* and 22*b* of pole 20 as shown.

Bypass valve 52 is securely fastened to pole 20, preferably at lower section 22*a*, using suitable clamps 72 while dump tube 66 is securely fastened, also preferably, to lower section 22*a* of pole 20 using clamp 74. While the precise location and orientation of bypass valve 52 and as a consequence dump tube 66 is a matter of operator preference, handle 64 is intended to be used as a support for pole 20 during operation. Consequently, bypass valve 52 should be mounted conveniently proximate to trigger housing 26, and oriented for left-hand or right-hand use, as the case may be.

In basic embodiments and as illustrated in the subject drawings, dump tube 66 conveniently directs fluid not ported to lance 40 away from the operator and the target surface—the fluid is of no use to the operator. Consequently, the exit orientation of end 67*b* is not material unless the exiting fluid is voluminous or otherwise demands alternative consideration. However, in more robust embodiments, end 67*b* of dump tube 66 is fitted with dump nozzle 68, which operates to materially increase the velocity of fluid exiting there from. Because a purpose associated with this modification is to increase the magnitude of reactive thrust imparted into assembly 10, thrust vector considerations should also be taken into account. Thus, if pole lift is the predominant objective, then nozzle 68 should be vectored down relative to the ordinary orientation of pole 20 during use. If pole stability is desired, then nozzle 68 can comprise two divergently oriented orifices such that the exiting fluid forms an inverted "V", i.e., a "Λ". Alternatively, output can be split between two nozzles, each being oriented in a desired direction to provide the desired result. Depending upon the embodiment, orientation can be fixed or operator selectable.

Finally, the length of dump tube 66 can be varied, either by adding/subtracting sections there from, or by using tubes of differing length. Through either means, the location of fluid expulsion is altered. In basic embodiments, establishing an expulsion location more distal from bypass valve 52 increases the weight to and handling effort of pole 20, but further distances the expelled fluid from the operator. However, in vectored reactive force embodiments, the force necessary to effect certain movement of pole 20 is lessened when the expulsion location is closer to lance 40, as is appreciated by the skilled practitioner. Therefore, the skilled practitioner would be able to select a suitable expulsion location based upon factors such as expulsion force and location on pole 20.

Operation of assembly 10 involves the linking of primary hose 34 to a suitable supply of pressurized fluid, preferably not to exceed 10 gpm and 3000 psi.

What is claimed:

1. In a pressure washing system comprising, during operation, a high pressure fluid pump in fluid communication with a source of fluid and a high pressure primary circuit including a binary valve, and further comprising a lance having an ejection nozzle in fluid communication with the high pressure circuit, wherein the lance is linked to an extension member to increase the reach of the lance relative to an operator and whereby fluid emanating from the ejection nozzle is intended to impinge upon a target surface, a variable reactive force arrangement comprising:

a variable bypass valve having a housing defining a bypass input, a bypass primary output and a bypass secondary output, and further having a movable element for selectively directing fluid from the bypass input to the bypass primary output and/or the bypass secondary output wherein the bypass input is coupled to the high pressure primary circuit of the system and the bypass primary output is coupled to the lance ejection nozzle; and a dump nozzle coupled to the bypass secondary output by a dump tube wherein the dump nozzle and/or dump tube is mounted to one of the lance or the extension member at a location between the bypass valve housing and the lance ejection nozzle, and is oriented in a direction substantially different from that of the lance ejection nozzle whereby fluid emanating from the dump nozzle does not substantially impinge upon the target surface subject to fluid emanating from the lance ejection nozzle.

2. The arrangement of claim 1 wherein the dump nozzle does not substantially increase back pressure at the bypass secondary output.

3. The arrangement of claim 1 wherein the dump nozzle is closer to the bypass valve than the lance ejection nozzle.

4. The arrangement of claim 1 wherein the bypass valve is physically between the primary valve and the ejection nozzle, and the dump nozzle is closer to the bypass valve than the ejection nozzle.

5. The arrangement of claim 1 wherein the extension member comprises at least two telescoping elements in concentric relationship to extend the functional length of the member.

6. The arrangement of claim 1 wherein the lance is fluidly coupled to the bypass primary output by a flexible hose.

7. The arrangement of claim 1 wherein the extension member comprises at least two telescoping elements in concentric relationship to extend the functional length of the member, and wherein the lance is fluidly coupled to the bypass primary output by a flexible hose partially disposed in at least one of the telescoping elements.

8. The arrangement of claim 1 wherein the dump nozzle materially increases the back pressure at the bypass secondary output whereby a reactive force is generated that assists the operator in raising the extension member when fluid is ejected from the dump nozzle.

9. The arrangement of claim 8 wherein the dump nozzle comprises two orifices.

10. A kit for retrofitting a high pressure fluid washing system where the system includes a high pressure fluid pump in fluid communication with a source of fluid and a high pressure primary circuit including a binary valve, and further comprising a lance having an ejection nozzle in fluid communication with the high pressure circuit, wherein the lance is linked to an extension member to increase the reach of the lance relative to an operator and whereby fluid emanating from the ejection nozzle is intended to impinge upon a target surface, the kit comprising:

a variable bypass valve having a housing defining a bypass input means, a bypass primary output means variably fluidly coupled to the bypass input means, and a bypass secondary output means variably fluidly coupled to the bypass input means, and further having a means for selectively directing fluid from the bypass input means to the bypass primary output means and/or the bypass secondary output means wherein the bypass input means is adapted to couple to the high pressure primary circuit of the system and the bypass primary output means is adapted to couple to the lance ejection nozzle; and a dump nozzle means for receiving fluid from the bypass secondary output wherein the dump nozzle means is adapted to mount to one of the lance or the extension member at a location between the bypass valve housing and the lance ejection nozzle, and is oriented in a direction substantially different from that of the lance ejection nozzle whereby fluid emanating from the dump nozzle means during operation does not substantially impinge upon the target surface subject to fluid emanating from the lance ejection nozzle.

11. A pressure washing system comprising:

a high pressure fluid pump in fluid communication with a source of fluid and a high pressure primary circuit including a binary valve;

a lance having an ejection nozzle in fluid communication with the high pressure circuit;

an extension member to which the lance is mounted to increase the reach of the lance relative to an operator, whereby fluid emanating from the ejection nozzle is intended to impinge upon a target surface;

a dump tube attached to the extension member and having a dump nozzle;

a bypass valve including a housing for selectively directing fluid from the high pressure primary circuit to the lance ejection nozzle and/or the dump nozzle, wherein the dump nozzle and/or dump tube is adapted to mount to one of the lance or the extension member at a location between the bypass valve housing and the lance ejection nozzle, wherein the dump nozzle is to oriented in a direction substantially different from that of the lance ejection nozzle whereby fluid emanating from the dump nozzle during operation does not substantially impinge upon the target surface subject to fluid emanating from the lance ejection nozzle.

12. The arrangement of claim 11 wherein the dump nozzle does not substantially increase back pressure at the bypass secondary output.

13. The arrangement of claim 11 wherein the dump nozzle is closer to the bypass valve than the lance ejection nozzle.

14. The arrangement of claim 11 wherein the bypass valve is physically between the binary valve and the ejection nozzle, and the dump nozzle is closer to the bypass valve than the ejection nozzle.

15. The arrangement of claim 11 wherein the extension member comprises at least two telescoping elements in concentric relationship to extend the functional length of the member.

16. The arrangement of claim 11 wherein the lance is fluidly coupled to the bypass primary output by a flexible hose.

17. The arrangement of claim 11 wherein the extension member comprises at least two telescoping elements in concentric relationship to extend the functional length of the member, and wherein the lance is fluidly coupled to the bypass primary output by a flexible hose partially disposed in at least one of the telescoping elements.

18. The arrangement of claim 11 wherein the dump nozzle materially increases the back pressure at the bypass secondary output whereby a reactive force is generated that assists the operator in raising the extension member when fluid is ejected from the dump nozzle.

19. The arrangement of claim 18 wherein the dump nozzle comprises two orifices.

* * * * *